US006221431B1

(12) United States Patent
Bisol et al.

(10) Patent No.: US 6,221,431 B1
(45) Date of Patent: Apr. 24, 2001

(54) METHOD OF HOT-GALVANIZING FERROUS MATERIALS

(75) Inventors: Francesco Bisol, Pieve Di Soligo; Inigo Quesada, Feletto; Hans Harald Schmidt, Tarzo, all of (IT)

(73) Assignee: Soprin S.R.L., Treviso (IT)

( * ) Notice: Subject to any disclaimer, the term of this patent is extended or adjusted under 35 U.S.C. 154(b) by 0 days.

(21) Appl. No.: 09/215,271

(22) Filed: Dec. 18, 1998

(30) Foreign Application Priority Data

Dec. 18, 1997 (IT) ..... PD97A0285

(51) Int. Cl.[7] ..... B05D 1/38; B05D 1/18; B05D 3/10

(52) U.S. Cl. ..... 427/310; 427/313; 427/329; 427/406; 427/419.8; 427/433

(58) Field of Search ..... 427/310, 313, 427/329, 406, 419.8, 433; 148/23, 26

(56) References Cited

U.S. PATENT DOCUMENTS

| | | | | |
|---|---|---|---|---|
| 3,206,324 | | 9/1965 | Daesen . | |
| 3,816,188 | * | 6/1974 | Chay | 148/26 |
| 3,943,270 | * | 3/1976 | Neu et al. | 427/310 |
| 4,802,932 | * | 2/1989 | Billiet | 148/23 |
| 5,354,623 | * | 10/1994 | Hall | 428/610 |
| 5,403,650 | * | 4/1995 | Baudrand et al. | 428/209 |
| 5,641,543 | * | 6/1997 | Brooks | 427/327 |

FOREIGN PATENT DOCUMENTS

| | | |
|---|---|---|
| 2173030 | 10/1973 | (FR) . |
| 830258 | 3/1960 | (GB) . |
| 5017860 | 1/1993 | (JP) . |
| 5-195179 * | 8/1993 | (JP) . |

* cited by examiner

*Primary Examiner*—Shrive Beck
*Assistant Examiner*—Michael Barr
(74) *Attorney, Agent, or Firm*—Sughrue, Mion, Zinn, Macpeak & Seas, PLLC

(57) ABSTRACT

In a method of hot-galvanizing ferrous materials, in order to improve results, there is provision, during the course of the galvanizing, for a step for the introduction of various suitable metals, preferably selected from aluminum, potassium, nickel, magnesium and manganese, which are introduced in the form of their salts.

7 Claims, No Drawings

METHOD OF HOT-GALVANIZING FERROUS MATERIALS

BACKGROUND OF THE INVENTION

1. Field of the Invention

The present invention relates to a method of hot-galvanizing ferrous materials in which, in order to improve results, there is provision, during the course of the galvanizing, for a step for the introduction of various suitable metals selected from a group of metals including aluminium and nickel.

2. Description of the Related Art

Within the technical field of methods of hot-galvanizing ferrous materials, it is known to add to the molten zinc of the galvanizing bath certain metal additives which have the property of improving brightness, adhesion, and/or the aesthetic or functional aspects of the galvanizing in general and of controlling the thickness of the layer of zinc in steels with high silicon content. Typically various metal additives such as nickel and aluminium are added in the form of ZnAl and ZnNi alloys.

SUMMARY OF THE INVENTION

The present invention is based on the observation that these metal additives which are added to the galvanizing bath do not achieve an optimal output. Zinc-aluminium alloys tend to float in the bath, whereas nickel tends to precipitate and bind to the mattes in the bottom, with a clear loss of effectiveness.

The technical object of the invention is to provide a method which permits optimal hot galvanizing both in terms of the aesthetic result (the brightness of the galvanized surface, etc. . . ) and in terms of the technical result (the adhesion of the galvanizing etc. . . ), at the same time preventing all of the problems complained of with reference to the prior art mentioned.

A further object of the invention is to achieve the above-mentioned results at an advantageously low cost.

These and further objects are achieved by the invention by a method of hot-galvanizing ferrous materials. According to this method, in order to improve results, there is provision, during the course of the galvanizing, between a fluxing step and the galvanizing bath, and preferably contextually to the fluxing step, for a step for the introduction of various suitable metals including aluminium, nickel, potassium and manganese introduced in the form of their salts dissolved in the fluxing bath. It is provided that the fluxing bath be sodium-free.

Said metals are therefore applied directly to the ferrous material to be galvanized, upstream of the galvanizing bath.

DETAILED DESCRIPTION OF THE PRESENT INVENTION

A preferred embodiment of the method comprises, in known manner, a fluxing step followed by a step for drying the ferrous material to be galvanized upstream of the galvanizing bath and the various metals are introduced before the drying step, preferably during the fluxing step.

In this case, there is provision, in the fluxing step, for the fluxing bath to be supplemented with the various metal salts and with a wetting non-surface-active additive of the type known by the trade name P150 BISOL, from Bisol S.p.A., of Pieve di Soligo (TV), Italy. The non-surface-active wetting additive allows a high uniformity in wetting the parts to be galvanized, avoiding local concentrations of the metal salts applied that are therefore uniformily distributed onto the material to be treated. The use of non-surface-active wetting additives and particularly of P150 BISOL as wetting agent provides for elimination of foam in the fluxing bath and advantageously reduces the subsequent formation of smokes and ashes during galvanization.

The characteristics and advantages of the invention will become clearer from the following detailed description of a preferred, non-limiting example.

EXAMPLE

A cycle for the hot galvanizing of ferrous material provides for the steps of:

a) pickling the material to be galvanized in a pickling bath containing a solution of hydrochloric or sulphuric acid; the ferrous products are immersed in the bath and undergo the pickling treatment in conventional manner;

b) washing in water;

c) fluxing in a fluxing bath of conventional composition but supplemented with aluminium, nickel and potassium salts; magnesium and/or manganese salts may be provided in the bath as additives; the concentrations preferably used, expressed as the weight of the salt added to a liter of fluxing bath, are as follows:

aluminium sulphate, between 0.2 and 2 g/l and preferably 0.5 g/l, nickel sulphate, between 0.2 and 2 g/l and preferably 0.8 g/l, potassium chloride, between 0.2 and 1 g/l and preferably 0.3 g/l;

the various metal salts used may be in the form either of sulphates or of chlorides although the formation given above is preferred;

the fluxing bath also contains ammonium salts ($NH_4Cl$) and zinc salts ($ZnCl_2$) in conventional manner; the fluxing bath is preferably supplemented with a non-surface-active wetting agent of the type known by the trade name P150 BISOL from BISOL S.p.A. of Pieve di Soligo (TV), Italy; the percentage of this wetting agent is between 0.008 and 0.08, preferably 0.04% by weight;

d) the ferrous product is then removed from the fluxing bath and dried; the various metal salts remain deposited on its surface, adhering thereto;

e) in the subsequent step of immersion in the galvanizing bath, the ferrous material to be galvanized thus transports with it the additives necessary to improve the deposition of the layer of zinc and the brightness thereof; the various metal salts interact with the molten zinc whilst remaining in the proximity of the ferrous product, so that their ineffective dispersal in the bath of molten zinc and consequent wastage are prevented.

The invention thus achieves the objects set and affords many advantages in comparison with conventional galvanizing methods in which the metal additives are introduced into the galvanizing bath in the form of zinc alloys. An optimal galvanizing output is obtained at a highly competitive cost in comparison with known methods.

What is claimed is:

1. A method of hot-galvanizing a ferrous material, comprising fluxing in a fluxing bath, drying, and galvanizing in a galvanizing bath, wherein various metals are introduced in the form of their salts directly to the ferrous material during the fluxing step upstream of the galvanizing bath, characterized in that said fluxing bath contains a mixture of salts of Ni, Al, K, and Mn, in which the various metals are introduced before the drying step;

wherein the various metal salts are added to the fluxing bath in the following quantities (expressed as the weight of the salt per liter of fluxing bath):
aluminum sulphate, between 0.2 and 2 g/l,
nickel sulphate, between 0.2 and 2 g/l,
potassium chloride, between 0.2 and 1 g/l.

2. A method according to claim 1, in which the fluxing bath is further supplemented with a wetting non-surface-active additive.

3. A method according to claim 1, in which the mixture comprises magnesium salts.

4. A method according to claim 1, in which the salts are preferably sulphates or chlorides.

5. A method according to claim 2, in which the percentage of wetting additive added to the fluxing bath is between 0.008% by weight and 0.08% by weight.

6. A method according to claim 1, wherein the aluminium sulphate is present in an amount of 0.5 g/l, the nickel sulphate is present in an amount of 0.8 g/l, and the potassium chloride is present in an amount of 0.3 g/l.

7. A method according to claim 5, wherein the percentage of the wetting additive added to the fluxing bath is approximately 0.04% by weight.

* * * * *